United States Patent [19]

Lowe et al.

[11] 4,228,022

[45] Oct. 14, 1980

[54] SULFURIZED ALKYLPHENOL-OLEFIN REACTION PRODUCT LUBRICATING OIL ADDITIVE

[75] Inventors: Warren Lowe, El Cerrito; Thomas V. Liston, San Rafael, both of Calif.

[73] Assignee: Chevron Research Company, San Francisco, Calif.

[21] Appl. No.: 53,114

[22] Filed: Jun. 28, 1979

[51] Int. Cl.[2] ..... C10M 1/54

[52] U.S. Cl. ..... 252/42.7; 252/46.4; 260/125; 260/137; 260/139

[58] Field of Search ..... 252/42.7, 45, 46.4; 260/125, 137, 139

[56] References Cited

U.S. PATENT DOCUMENTS

| | | | |
|---|---|---|---|
| 3,336,224 | 8/1967 | Allphin, Jr. | 252/42.7 X |
| 3,367,867 | 2/1968 | Abbott et al. | 252/42.7 X |
| 3,706,665 | 12/1972 | Bell et al. | 252/42.7 X |
| 3,746,698 | 7/1973 | Hunt et al. | 252/45 X |
| 3,761,414 | 9/1973 | Haugen et al. | 252/42.7 |
| 3,801,507 | 4/1974 | Hendrickson et al. | 252/42.7 |

*Primary Examiner*—Andrew Metz

*Attorney, Agent, or Firm*—D. A. Newell; S. R. LaPaglia; J. J. DeYoung

[57] ABSTRACT

Disclosed is a novel composition formed from the reaction of (a) an alkylphenol; (b) sulfur; (c) an alkaline earth metal and (d) an olefin. The composition is useful as a lubricating oil additive and provides both oxidation and corrosion control.

7 Claims, No Drawings

SULFURIZED ALKYLPHENOL-OLEFIN REACTION PRODUCT LUBRICATING OIL ADDITIVE

BACKGROUND OF THE INVENTION

Lubricating oils used under the severe conditions of gasoline and diesel engines are highly compounded particularly to provide neutralization of acids derived from the sulfur in the fuel and from the oxidation of hydrocarbons; dispersancy so as to maintain sludge-forming precursors dispersed in the oil; improved wear protection and oiliness properties; as well as enhancing other attributes of the oil.

The desirability of having a single additive providing multifunctional properties is evident in the efficiency and economics in the manufacturing and use of a single additive as compared to a plurality of additives. However, because of the severe operating conditions under which lubricants perform in internal combustion engines, it is frequently found that one additive, while effectively performing a particular function, will tend to cause another problem.

Sulfurized alkylphenols are well known in the lubricants art as precursors for making lubricating oil additives. More particularly, sulfurized alkylphenols are well known as precursors for neutral and overbased alkaline earth metal phenates. See, for example, U.S. Pat. Nos. 3,367,867, and 3,741,896. Similarly, the sulfurized alkylphenols have been used in many other reactions, for example, the reaction of a sulfurized phenol with a Mannich base, U.S. Pat. No. 3,741,896.

The sulfurized alkylphenols cannot themselves be used as a lubricating oil additive because of their corrosive effect on engine parts. This corrosiveness is believed to be due in part to the presence of free sulfur found in the product of the reaction of sulfur and phenol.

SUMMARY OF THE INVENTION

A novel lubricating oil additive formed from the reaction of: (a) an alkylphenol; (b) sulfur; (c) an alkaline earth metal and (d) an olefin. The reaction product, when added to a lubricant, provides both oxidation and corrosion control.

DETAILED DESCRIPTION OF THE INVENTION

The invention involves the reaction of: (a) an alkylphenol; (b) sulfur; (c) an alkaline earth metal salt and (d) an olefin under reaction conditions suitable to form a reaction product essentially free of residual free sulfur. As used in the present application, the term "free sulfur" means sulfur that is analyzed by the polarographic method. See "The Analytical Chemistry of Sulfur and Its Compounds" H. I. Karchmer, Wiley Interscience New York (1970), page 82. This method of analysis determines the quantity of sulfur in the elemental, unreacted state, as well as sulfur occurring in polysulfide bonds, i.e., that sulfur in excess of that required for a monosulfide bond. Typical examples are the sulfur in a tetrasulfide or a trisulfide. It is thought to be composed of unreacted sulfur and sulfur in polysulfide compounds. The reaction can be preformed in one or more steps. Preferably, the reaction mixture of the present invention is formed in two reaction steps with the sulfurized alkylphenol being formed in the first step followed by reaction of the sulfurized phenol with an olefin in the second step.

First Processing Step

The reaction of an alkylphenol, metal base and sulfur is well known in the art and proceeds substantially as shown in the following chemical equation:

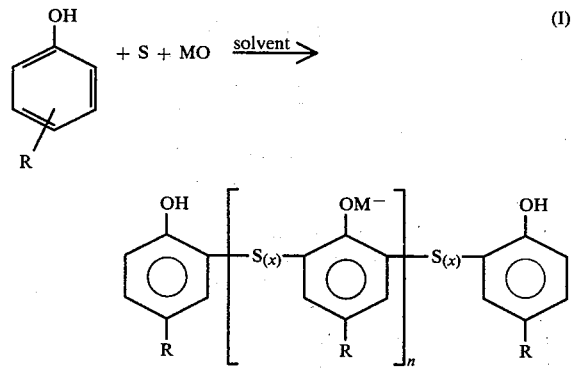

(I)

wherein:

R is an alkyl group having from 8 to 35 carbons;

x is an integer from 1 to 4;

M is an alkali or alkaline earth metal;

n is an integer from 0 to 10.

The above equation represents a broad and simplified version of the reaction between the alkylphenol, sulfur and metal base. The intermediate product is not a pure compound having only one single structure, but, rather, is a mixture of numerous sulfurized compounds where n and x have several values. Similarly, the metal atom may be bonded to one or more phenolic groups through a co-valent bond or ionized and exist as cations with the intermediate reaction product. Thus, it is apparent that while the above description of the sulfurized phenol reaction intermediate represents a general description, it should not be interpreted as limiting the invention.

The three reactants are preferably charged to a suitable reaction vessel and agitated prior to the addition of a mutual hydroxylic solvent. Ethylene glycol, propylene glycol, 1,4 butanediol and methanol are examples of suitable solvents. Ethylene glycol is the preferred solvent.

In addition to a hydroxylic solvent, inert hydrocarbon diluent may also be present. These inert diluents may serve to aid in the handling of the reactants, lowering the viscosity of the reaction mixture.

Although any of the alkali or alkaline earth metal salts can be used, for example, calcium hydroxide, barium oxide, magnesium oxide, sodium hydroxide and potassium hydroxide, it is preferred to use calcium oxide.

Second Processing Step

In the second processing step, the sulfurized phenol reaction product from the first step is reacted with an olefin. The olefin is believed to react with the residual-free sulfur in the first step reaction product to form a second complex reaction mixture.

Any olefin which reacts with the sulfur in the sulfurized phenol reaction product is suitable. Preferably the olefin contains 10 to 30 carbon atoms, more preferably 15 to 20 carbon atoms. Branched-chain and straight-chain olefins can be utilized. Similarly, alpha olefins and internal olefins can be used. Most preferred are the straight-chain alpha olefins containing 15 to 20 carbon atoms.

Reaction Conditions

The reactions conditions for the present invention are critical to obtaining a product which functions as an antioxidant and also has the desired anti-corrosion properties. It has been found that, if the ratio of sulfur to phenol in the reaction product is too low, then the product loses its effectiveness as an antioxidant, while, if the sulfur to phenol ratio is too high, the product is too corrosive. The sulfur to alkylphenol ratio in the final reaction product, i.e., after reaction with the olefin described above, should be in the range 1.0 to 2.2, preferably 1.8 to 2.0.

Similarly, for the product to have the desired anticorrosive properties, it has been found that the sulfurized phenol must be reacted with sufficient olefin under suitable reaction condition such that the final product is essentially free of residual-free sulfur. As used in the present application, essentially free of free sulfur means less than 1.0 weight percent in the final reaction product and preferably less than 0.6 weight percent.

The concentraton of reactants based on the weight of phenol charged and process conditions are shown in the following Table I.

TABLE I (Two-step Preparation)

| Component Concentration (Wt) | Broad Range | Preferred Range |
|---|---|---|
| Alkylphenol | 1 | 1 |
| Sulfur | 0.10–.30 | 0.1–0.3 |
| Alkaline earth metal | 0.02–0.4 | 0.02–0.06 |
| Olefin | 0.05–0.25 | 0.1–0.2 |
| Hydroxylic solvent | 0.025–0.25 | 0.05–0.1 |
| Reaction time, hrs. (Step 1) | 2–24 | 4–10 |
| Reaction temperature, °F. (Step 1) | 300–400 | 340–360 |
| Reaction time, hrs. (Step 2) | 1–24 | 4–8 |
| Reaction Temperature, °F. (Step 2) | 250–400 | 250–280 |

As previously stated, the product of the present invention can also be prepared in a one-step process. For a one-step process, the concentration of reactants is the same as listed in Table I, however, the preferred process conditions for a one-step preparation include a temperature of 250° to 360° F., and a reaction time of 4 to 8 hours.

PREPARATION OF LUBRICANT COMPOSITION

The lubricant composition of this invention can be prepared by simply mixing the sulfurized phenol-olefin reaction product within a suitable lubricating oil or lubricating oil compositions. The concentration of phenol-olefin reaction product within the lubrication oil composition to realize the desired antioxidant and anticorrosion properties varies depending upon the type of sulfurized phenol-olefin selected, the particular properties desired and the type of lubricating oil selected. Generally, however, the concentrations of the sulfurized alkylphenol-olefin reaction product ranges from 0.5 to 15 weight percent and more preferably from 1 to 8 weight percent. Thus, the lubricating oil compositions generally have a sulfur content between about 0.03 and 3 weight percent.

The lubricating oil which may be employed in the practice of this invention includes a wide variety of natural and synthetic oils such as naphthenic base, paraffin base and mixed base lubricating oils. The oils generally have a viscosity of 35 to 50,000 SUS at 100° F., or from 30 to 150 SUS (Saybolt Universal Seconds) at a temperature of 210° F. Other hydrocarbon oils include oils derived from coal products and synthetic oils, e.g., alkylene polymers, (such as polymers of propylene, butylene, etc., and mixtures thereof), alkylene oxide type polymers (e.g., alkylene oxide polymers prepared by polymerizing alkylene oxide, e.g., propylene oxide polymers, etc., in the presence of water or alcohols, e.g., ethyl alcohol, carboxylic acid esters, (e.g., those which were prepared by esterifying such carboxylic acids as adipic acid, azelaic acid, suberic acid, sebacic acid, alkenyl succinic acid, fumaric acid, maleic acid, etc., with the alcohol such as butyl alcohol, hexyl alcohol, 2-ethylhexyl alcohol, pentaerythritol, etc.), liquid esters of phosphorus acids, alkyl benzenes, polyphenols (e.g., biphenyls and terphenyls), alkyl bisphenol ethers, polymers of silicon, e.g. tetraethyl silicate, tetraisopropyl silicate, hexyl (4-methyl-2-pentoxy)disilicate, poly(methyl) siloxane, and poly(methylphenyl) siloxane, etc. The lubricating oils may be used individually or in combinations, whenever miscible or whenever made so by the use of mutual solvents.

In addition to the sulfurized alkylphenol-olefin reaction product, other additives may be successfully employed within the lubricating composition of this invention without affecting its multi-functional properties. Exemplary additives include stabilizers, extreme pressure agents, tackiness agents, pour point depressants, lubricating agents, viscosity index improvers, color correctors, odor control agents, antiwear agents, antioxidants, metal deactivators, anticorrodants, etc.

The following examples are presented to illustrate the practice of specific embodiments of this invention and should not be interpreted as limitations upon the scope of the invention.

Example 1—One-Step Preparation

A 2-liter 3-necked round bottom flask equipped with a stirrer, thermometer, thermostat and a reflux condenser was charged with 548 grams of p-dodecylalkylphenol, 33.6 grams of calcium oxide and 77 grams of a mixture of about equal portions of $C_{15}$–$C_{18}$ 1-olefins, particularly pentadecene-1, hexadecene-1, heptadecene-1, and octadecene-1. This mixture was stirred for 15 minutes at 90° C.; then 116 grams of sulfur was added. The temperature was raised to 135–140° C. and the stirring was continued at this temperature for 1½ hours. The reactants were maintained under a nitrogen atmosphere. At the end of this time 26 grams of ethylene glycol was added. The temperature was raised to 175–180° C. and a vacuum of about 350 mm of mercury was applied to the reaction vessel. Stirring was continued for another 4 hours during which time the water and ethylene glycol were removed overhead. The resulting mixture was stripped of all volatile material at 180° C. under 100 mm of mercury. Then 135 grams of Citcon 100 neutral lube oil was added. The mixture was stirred for 30 minutes at 180° C. At this time, the reaction mixture weighed 818 grams. It was filtered while hot to give 761 grams of final product concentrate. Analysis gave 7.9% total sulfur. A polarographic analysis gave 0.4% free sulfur.

Example 2–Two-Step Preparation a. Sulfurized alkyl phenol was prepared by the method of Abbott (U.S. Pat. 3,741,896, Example A) by heating 2 mols of sulfur, 1 mol of dodecylphenol, 0.30 parts of calcium oxide and 0.21 parts of ethylene glycol for 4 hours at 180° C. The resulting product is then stripped of all volatile material at 180° C. under 100 mm of mercury vacuum. The resulting material was dissolved in 100 neutral mineral oil to give a final concentrate having a solids content of 80% by weight.

b. Other reactions were carried out in which the sulfur to alkylphenol mol ratio was 1.8, 1.6, 1.4, 1.2 and 1.0. In each case the final concentrate contained about 80–90 percent by weight of solids.

c. Each of the above-described sulfurized alkylphenols were mixed with 10% by weight of the previously described (Example 1) mixture of $C_{15}$–$C_{18}$ 1-olefins. The resulting mixture was heated and stirred for 4 hours at 135° C. The resulting product was filtered while hot.

d. Other compounds were made under varying conditions of temperature and heating time as well as with different weight ratios of olefin to sulfurized alkylphenol. The data on all compounds is found in Table II.

The compositions of this invention are useful lubricating oil additives which impart both oxidation resistance and improved bearing corrosion properties to the resulting mixture. The products were tested in engine use applications using the L-38 Engine Test to determine bearing corrosion and a slightly modified ASTM sequence IIID test to measure oxidation resistance. The L-38 Engine Test is described in detail in U.S. Pat. No. 3,558,490, the disclosure of which is incorporated herein by reference. In both tests, an internal combustion engine is operated using the test composition as the lubricating agent. In the L-38 Engine Test the engine bearings are weighed before and after a 40-hour run. A weight loss of less than 40 mg is passing. In the Sequence IIID test, the viscosity of the lubricating agent is measured periodically, and the time to reach a 500% increase in viscosity is found. Times of 40 hours or less are considered unsatisfactory. The time to reach this increase in viscosity for the test composition is then compared to the time required for the same composition without the test material. The results are given as a percent increase in time. Satisfactory compositions should give typically a 25% minimum improvement. The anti-corrosion properties of the compositions were also tested using the copper strip test ASTM test method D-130. Satisfactory results are typically 1A-2B colors in the ASTM D-130. The results of the various tests are shown in Table II. In the tests the following base oil formulations were used:

(1) 6% of a 45% solution of a succinimide dispersant, 50 mmols of a 400 AV magnesium phenate, 18 mmols of a zinc dithiophosphate, 0.25% of a 50% solution of zinc dialkylthiocarbamate, and 7.8% of an ethylene/propylene copolymer VI improver in a 148 neutral Sun Oil Co. base oil.

(2) 3.5% of a 45% solution of a succinimide dispersant, 30 mmols of a 400 AV magnesium phenate, 20 mmols of a carbonated, sulfurized, calcium dodecylphenate, 18 mmols of a zinc dithiophosphate, and 8.2% of a polyacrylate dispersant VI improver in a 148 neutral Sun Oil Co. base oil.

(3) 3.5% of a 45% solution of a succinimide dispersant, 30 mmols of a 400 AV magnesium phenate, 20 mmols of a carbonated, sulfurized, calcium dodecylphenate, 18 mmols of a zinc dithiophosphate, and 5.5% of a polyacrylate polymer in an RPM neutral base oil.

TABLE II

| | | TEST COMPOSITIONS AND ENGINE RESULTS | | | | | | | |
|---|---|---|---|---|---|---|---|---|---|
| Test No. | Sulfur:Alkylphenol (Mols ratio) | Olefin (Wt. %) | Rx. Time (hrs.) | Reaction Steps | Sulfur Total | (wt %) Free | L-38[1] (mg) | IIID[2] (%) | Copper Strip Rating |
| 1 | 2.0:1 | 0 | — | — | — | — | — | 250[3] | — |
| 2 | 2.0:1 | 0 | — | — | — | — | — | 43[4] | — |
| 3 | 2.0:1 | 0 | — | — | 8.9 | 1.4 | — | — | 3A |
| 4 | 1.8:1 | 0 | — | — | 9.4 | 1.5 | 64[5] | — | 3A |
| 5 | 1.6:1 | 0 | — | — | — | — | 47[5] | — | — |
| 6 | 1.4:1 | 0 | — | — | — | — | — | 12[6] | — |
| 7 | 1.4:1 | 0 | — | — | — | — | — | 57[7] | — |
| 8 | 1.2:1 | 0 | — | — | — | — | 51[5] | — | — |
| 9 | 2.0:1 | 20 | 4 | 2 | — | — | 42 | — | — |
| 10 | 2.0:1 | 10 | 4 | 2 | 7.9 | 0.6 | 38 | 33 | 1A |
| 11 | 2.0:1 | 10 | 4 | 2 | 9.3 | 0.8 | 38 | — | 1A |
| 12 | 2.0:1 | 10 | 12 | 2 | 8.6 | 0.5 | — | — | 1A |
| 13 | 2.0:1 | 10 | 24 | 2 | 8.6 | 0.5 | 35 | — | 1A |
| 14 | 1.8:1 | 10 | 4 | 2 | 8.8 | 0.7 | 36 | 54 | 2A |
| 15 | 1.8:1 | 10 | 4 | 2 | 8.0 | 0.7 | — | 62 | 1A |
| 16 | 1.8:1 | 10 | 12 | 2 | — | — | — | 8 | — |
| 17 | 1.8:1 | 5 | 4 | 2 | 7.6 | 1.0 | — | — | 1B |
| 18 | 2.0:1 | 10 | 4 | 1 | 7.9 | 0.4 | 31 | 31 | — |

1. The L-38 test was carried out at 1.1% concentration in the formulation[2].
2. The III-D test was carried out at 1.65% concentration in the formulation[3].
3. This III-D test was carried out at 2.0% concentration in the formulation[1].
4. This III-D test was carried out at 1% concentration in the formulation[1].
5. This L-38 test was carried out at 1% concentration in the formulation[2].
6. This III-D test was carried out at 1.5% concentration in the formulation[3].
7. This III-D test was carried out at 2.0% concentration in the formulation[3].

The data in Table II illustrates that the sulfurized alkylphenol-olefin reaction product of the present invention provide both excellent oxidation and corrosion control compared to sulfurized alkylphenols which have not been reacted with an olefin in accordance with the present invention.

What is claimed is:

1. An additive composition for use in crankcase lubricating oils comprising the reaction product of: (a) an alkylphenol; (b) sulfur; (c) an alkali or alkaline earth metal salt and (d) an olefin; said reaction product being formed under reaction conditions suitable to form a reaction product containing less than 1.0 weight percent free-sulfur.

2. The composition in claim 1, wherein said reaction conditions include a weight ratio of alkylphenol:sulfur:alkaline earth metal salt:olefin in the range of 1:0.15–.3:0.2–0.4:0.1–0.2.

3. The composition of claim 1, wherein the molar ratio of sulfur to alkylphenol in said reaction product is in the range of 1.0 to 2.2.

4. The composition of claim 1, wherein said alkylphenol, sulfur and alkaline earth metal salt are reached in a first reaction step at temperature in the range 340° to 360° F. for 2 to 10 hours to form a sulfurized alkylphenol having a molar ratio of sulfur to alkylphenol in the range 1.8 to 2.0, said sulfurized phenol then being reacted in a second reaction step with an olefin at a temperature in the range 250° to 280° F. for 4 to 8 hours.

5. The composition of claim 4, wherein said reactants include: an alkylphenol having 8 to 35 carbon atoms in the alkyl group, said alkaline earth metal salt is calcium oxide, and said olefin is a straight-chain alpha-olefin containing 15 to 18 carbon atoms.

6. A lubricating oil additive concentrate which comprises from 90–10 percent weight of an oil of lubricating viscosity and 10–90 percent weight of the composition of claim 1.

7. A lubricating oil composition of claim 1, comprising an oil of lubricating viscosity and an antioxidant amount of the composition of claim 1.

* * * * *